US008659226B2

(12) United States Patent
Brauner et al.

(10) Patent No.: US 8,659,226 B2
(45) Date of Patent: Feb. 25, 2014

(54) HIGH-PRESSURE DISCHARGE LAMP HAVING AN IGNITION AID

(75) Inventors: Thomas Brauner, Berlin (DE); Johannes Buttstaedt, Falkensee (DE); Sascha Piltz, Berlin (DE)

(73) Assignee: OSRAM AG, Munich (DE)

( * ) Notice: Subject to any disclaimer, the term of this patent is extended or adjusted under 35 U.S.C. 154(b) by 64 days.

(21) Appl. No.: 13/389,442

(22) PCT Filed: Jul. 26, 2010

(86) PCT No.: PCT/EP2010/060763
§ 371 (c)(1), (2), (4) Date: Feb. 8, 2012

(87) PCT Pub. No.: WO2011/018326
PCT Pub. Date: Feb. 17, 2011

(65) Prior Publication Data
US 2012/0139412 A1 Jun. 7, 2012

(30) Foreign Application Priority Data

Aug. 14, 2009 (WO) ..... PCT/EP2009/060572
Sep. 30, 2009 (DE) ..... 20 2009 013 109 U

(51) Int. Cl.
*H01J 61/54* (2006.01)

(52) U.S. Cl.
USPC ..... 313/594; 313/607

(58) Field of Classification Search
USPC ..... 313/25, 54, 234, 594, 607, 623–625, 313/631, 632, 635; 315/59, 330, 335; 362/217.16, 221
See application file for complete search history.

(56) References Cited

U.S. PATENT DOCUMENTS

| | | | | |
|---|---|---|---|---|
| 3,872,340 | A | 3/1975 | Collins | |
| 4,053,809 | A | 10/1977 | Fridrich et al. | |
| 4,924,133 | A | 5/1990 | Dassler et al. | |
| 5,075,586 | A * | 12/1991 | Jaeger et al. | 313/25 |
| 6,268,698 | B1 | 7/2001 | Scholz | |
| 2001/0003411 | A1* | 6/2001 | Honda et al. | 313/607 |
| 2010/0117509 | A1* | 5/2010 | Li et al. | 313/323 |

FOREIGN PATENT DOCUMENTS

| | | | |
|---|---|---|---|
| DE | 102006001243 | A1 | 7/2007 |
| EP | 0316617 | B1 | 5/1993 |
| EP | 0967631 | A1 | 12/1999 |
| EP | 0922296 | B1 | 3/2002 |
| EP | 1391914 | A2 | 2/2004 |
| WO | 2007080164 | A1 | 7/2007 |

* cited by examiner

*Primary Examiner* — Nimeshkumar Patel
*Assistant Examiner* — Steven Horikoshi

(57) ABSTRACT

A high-pressure discharge lamp with an ignition aid has a discharge vessel which is mounted in an outer bulb, the discharge vessel comprising two ends having seals in which electrodes are secured, and a frame having a clip wire retaining the discharge vessel in the outer bulb. The clip wire comprises a plate-like part acting as an ignition aid and facing the seal of the opposite pole electrode.

13 Claims, 16 Drawing Sheets

HIGH-PRESSURE DISCHARGE LAMP HAVING AN IGNITION AID

RELATED APPLICATIONS

The present application is a national stage entry according to 35 U.S.C. §371 of PCT application No.: PCT/EP2010/060763 filed on Jul. 26, 2010, which claims priority from PCT application No.: PCT/EP2009/060572 filed on Aug. 14, 2009, and from German application No.: 20 2009 013 109.2 filed on Sep. 30, 2009.

TECHNICAL FIELD

Various embodiments relate to high-pressure discharge lamps, and in particular high-pressure discharge lamps for general lighting or for photo-optical purposes.

BACKGROUND

A high-pressure discharge lamp having a discharge vessel is known from U.S. Pat. No. 6,268,698, wherein an ignition aid is based on a long frame wire. The ignition aid is a separate component which extends on the level of a capillary in the direction of the discharge vessel.

The disadvantage of such an arrangement is the fact that the ignition aid has a complex and costly installation requirement.

SUMMARY

Various embodiments provide a high-pressure discharge lamp, the ignition of which is ensured by simple cost-effective means. This applies in particular to metal halide lamps, whereby the material of the discharge vessel can be quartz glass or ceramic.

In various embodiments, a separate component is now used on the frame, which extends in the direction of a seal of the discharge vessel, in particular designed as a pinch or capillary. The component is located on the long power supply line, the so-called clip wire of the frame, namely preferably in a region in the vicinity of the pinch. The separate component is located on the long power supply line, the so-called clip wire of the frame, namely preferably in a region in the vicinity of the capillary, in particular where the electrode sits in the capillary, but is spaced away from the wall of the capillary With an increasing service life, there is a rise in the requisite voltage for the ignition of high pressure discharge lamps. The effect of this can be that old lamps are no longer started by conventional ignition devices. Rather, the ignition capability should be ensured over the entire service life, this being achieved by various embodiments, without incurring significant additional costs.

To date, there have been various approaches to solving this.

a) A radioactive gas such as Kr85, for example, is added to the burner fill gas. The ionization of the fill gas effected by the radioactivity reduces the breakdown voltage, thus ensuring the ignition capability. However, the use of radioactivity is subject to increasing restriction by legislation.

b) A so-called UV enhancer is installed in the outer bulb.

Said enhancer includes a miniaturized discharge tube that emits UV radiation upon the application of the ignition voltage. This UV radiation likewise effects ionization of the burner fill gas, thus ensuring the ignition capability, see EP-A 922296.

c) From the clip wire, a wire is wound around the capillary with the oppositely poled electrode. Consequently, upon application of the ignition voltage, a dielectrically impeded discharge is produced in the region of this electrode, which ionizes the burner fill gas and reduces the ignition voltage, see for example EP-A 967631.

Various embodiments adopt the principle of dielectrically impeded discharge, but improve it decisively.

The clip wire is designed such that an ignition aid runs from there as close as possible to the seal with the oppositely poled electrode, or touches said seal. Similarly to the case of the wire windings mentioned under c), a dielectrically impeded discharge is produced which ionizes the fill gas in the burner and enables a breakdown. Characteristic of this approach to a solution is the fact that in contrast to previous solutions the ignition aid is a plate-like metal part. The metal part is in particular a foil or a sheet metal part, in particular also a spring element. A typical size for a foil or sheet metal part is a rectangle having dimensions of 1 mm×10 mm.

In a first preferred exemplary embodiment, a metal foil preferably made of molybdenum or tungsten which touches the seal with the electrode having the opposite potential is welded on the clip wire. There, similarly to the case of the wire windings mentioned under c), a dielectrically impeded discharge is produced which ionizes the fill gas in the burner and enables a breakdown.

Characteristic of this approach to a solution is the use of a flexible foil which on account of its flexibility is always in contact with the seal of the discharge vessel. For this purpose, the foil must be very thin, in any event thinner than 200 μm, preferably between 20 μm and 40 μm. The foil has no mechanical supporting effect. It extensively covers the seal.

The foil can be in contact. It can however also cover the seal partially or completely or wind around the seal.

The foil is secured to the clip wire either by a material connection (for example using a welding process) or by a friction-locked connection (for example by clamping or crimping).

With respect to the seal the foil can in particular abut with the tip against, tangentially overlap or wind around the capillary. As simple a geometry as possible which does not adversely affect production is preferred.

The ignition aid preferably exhibits as small as possible a spacing from the oppositely poled current-carrying electrode, whereby the location of the smallest spacing should be situated wherever possible in the vicinity of the actual discharge vessel.

In various embodiments, radioactive additions are no longer required. A foil routed to the seal is very simple to implement in manufacturing terms in the case of single-ended lamps, namely considerably simpler than a wire winding of the seal. Furthermore, in contrast to UV enhancers the foil requires hardly any additional space in outer bulbs. The risk of the ignition aid losing its functionality or position as a result of a poor joint with the clip wire during the service life is practically non-existent because a foil can be secured over a relatively large area.

A foil welded on the clip wire is very simple to implement in manufacturing terms in the case of single-ended lamps, namely considerably simpler than a wire winding of the pinch. Furthermore, in contrast to UV enhancers this foil requires no additional space in outer bulbs.

Thanks to its mechanical flexibility, a foil can be pressed against the seal with prestressing, by means of which a reliable and permanent contact is ensured. The foil can also be coated or doped.

A foil can be easily kinked and nevertheless remains stable in form thereafter. It can however also be kept stable in form by means of skillful suitable arrangement.

In a second preferred exemplary embodiment, a metal plate preferably made of stainless steel which partially or completely surrounds the seal is welded on the clip wire.

With regard to the filling, in particular with regard to discharge vessels made of quartz glass, care must preferably be taken to ensure that it is essentially free of Na, in particular manages completely without Na iodide or similar. Instead, rare earth metal halides are preferably used, as already known, for example in a mixture with thallium iodide or similar.

The seals of the discharge vessel made of quartz glass or ceramic can be capillaries, fusions or pinches.

BRIEF DESCRIPTION OF THE DRAWING(S)

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

PREFERRED EMBODIMENT OF THE INVENTION

Figure 1:
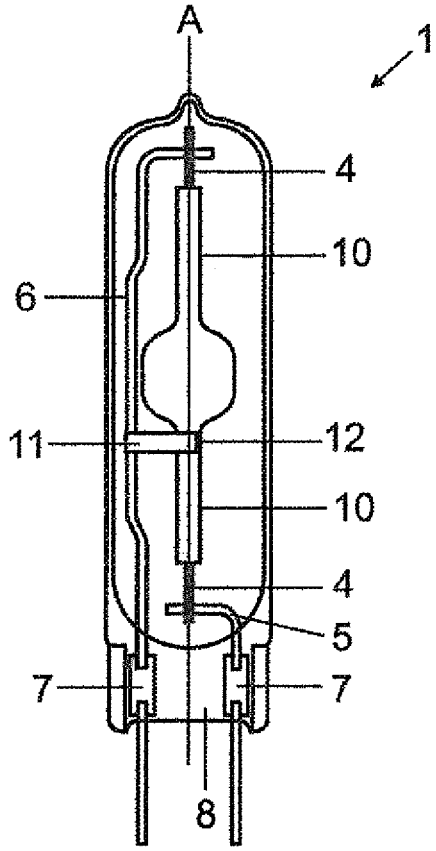
FIG. 1 shows a high-pressure discharge lamp having an ignition aid, first exemplary embodiment.

FIG. 1 shows the structure of a high-pressure discharge lamp 1 in heavily schematized form. It has a discharge vessel 2 which is mounted in an outer bulb 3. The external feed lines 4 of the discharge vessel, which make contact with electrodes in the interior, are connected to two frame wires 5 and 6. A short frame wire 5 leads to a first foil 7 in a pinch 8 of the outer bulb. A long frame wire 6, often referred to as clip wire, leads to a second foil 7 in the pinch 8. The discharge vessel 2 has at each of its ends a capillary 10, as already known, and also a filling which contains metal halides, as likewise already known. In this situation, this may contain Hg, and also an inert gas. Two electrodes are situated opposite one another in the interior of the discharge vessel, as likewise already known, but are not illustrated here. A typical filling is an ionizable gas, as a rule argon or xenon, mercury and metal halides.

The clip wire 6 is essentially routed along the discharge vessel parallel to the axis A thereof to the second capillary 10 distant from the pinch 8. There it is connected to the feed line 4.

Figure 2:
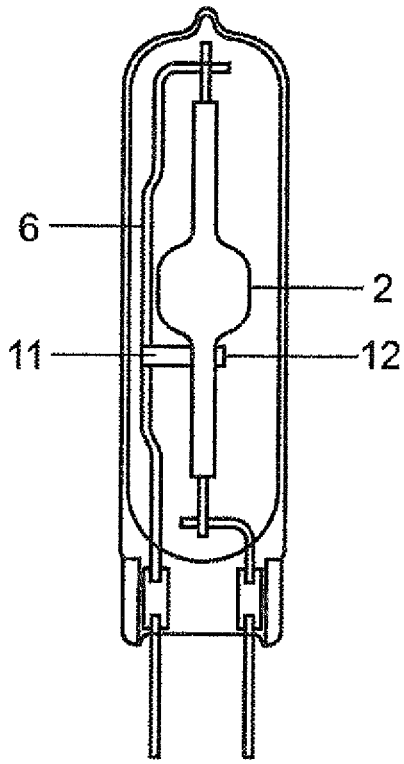
FIG. 2 shows a high-pressure discharge lamp having an ignition aid, second exemplary embodiment.

In the region of the first capillary 10 a foil 11 which is approximately rectangular in shape is welded on the clip wire 6 in the direction of the capillary. The free end 12 of the foil extends approximately to the top of the capillary 10. It can just touch the capillary or also be routed tangentially past the capillary, see FIG. 2.

Figure 3:
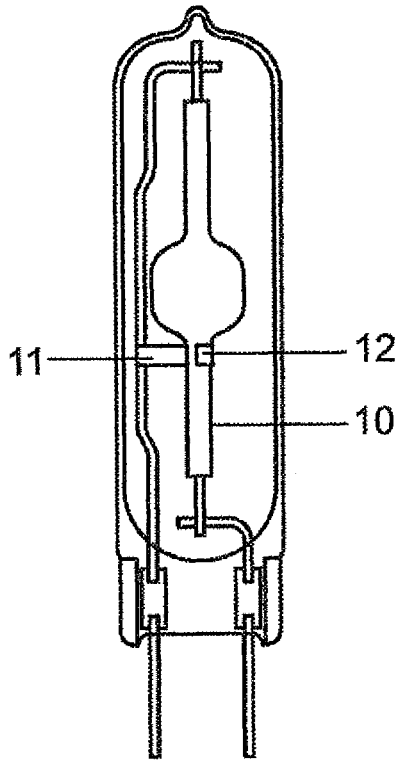
FIG. 3 shows a high-pressure discharge lamp having an ignition aid, third exemplary embodiment.

In FIG. 3, the foil 11 is sufficiently long that its free end 12 is at least partially wound around the capillary 10. In this situation, the foil ends in the vicinity of the capillary 10.

Figure 4:
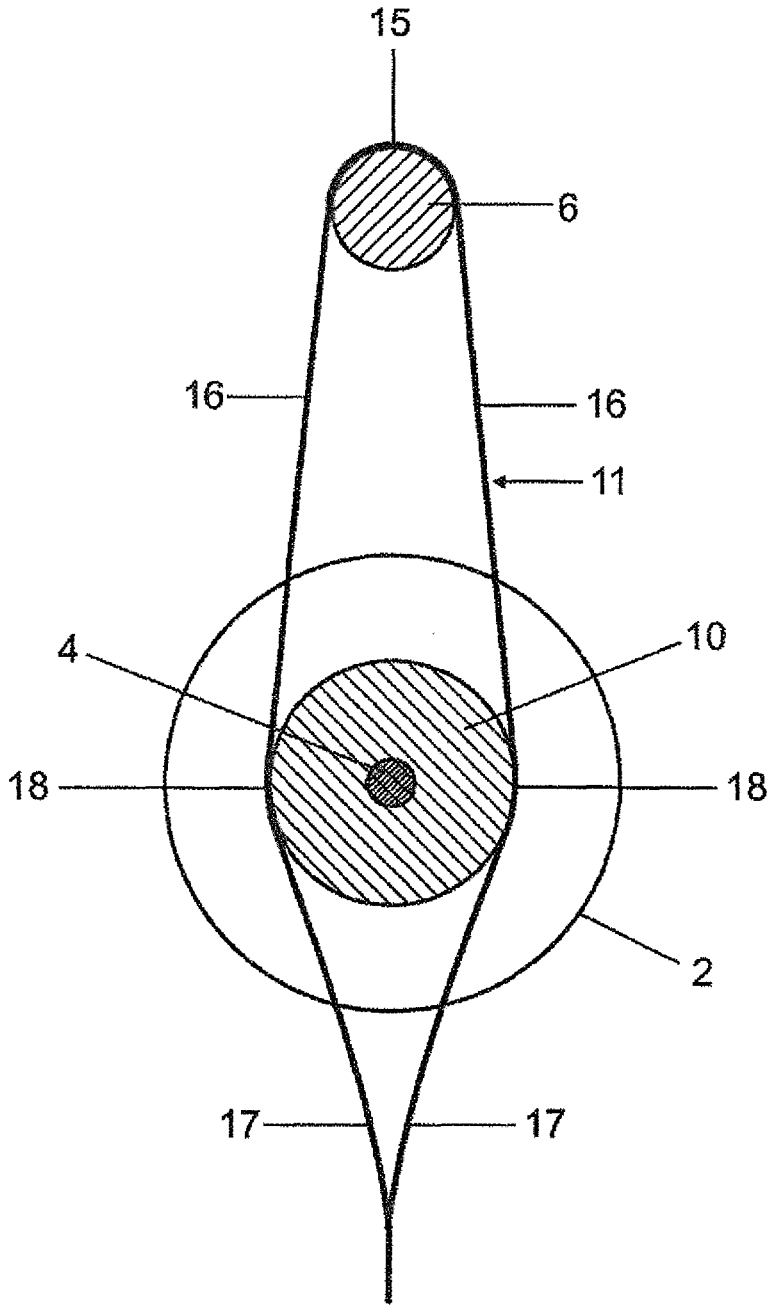
FIG. 4 shows a high-pressure discharge lamp having an ignition aid, fourth exemplary embodiment.

FIG. 4 shows an exemplary embodiment which forces stability of form. In this situation, the foil 11 is of such a length that it is more than twice as long as the distance between clip wire 6 and capillary 10. By this means it is possible to secure the foil 11 approximately at its center 15 on the clip wire 6. The limbs 16 extend in the direction of the capillary 10. Both limbs 16 are initially free, but limbs 16 are routed beyond the capillary 10 of the oppositely poled electrode and touch the capillary 10 on two opposite sides 18. The free ends 17 of the foil are still sufficiently long behind the capillary 10 that they can be positioned next to each other at an acute angle and connected, in particular welded. By this means the capillary 10 is clamped between the two limbs 16 of the foil. The ignition aid acts from two sides 18.

Figure 5:
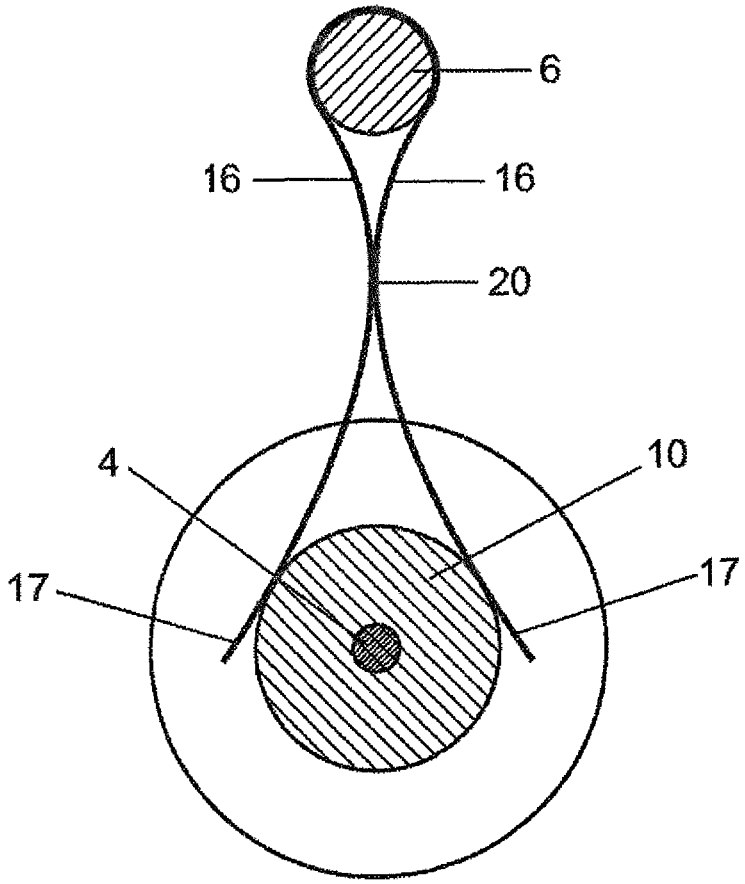
FIG. 5 shows a high-pressure discharge lamp having an ignition aid, fifth exemplary embodiment.

FIG. 5 shows a similar configuration with two free limbs 16 of the foil. In this situation however it is not the free end of each limb that is connected but a region 20 approximately in the center between clip wire 6 and capillary 10. By this means the capillary 10 is clamped between the free ends 17 of the foil. Here, the overall length of the foil can be shorter than chosen in the case of FIG. 4.

Figure 6:
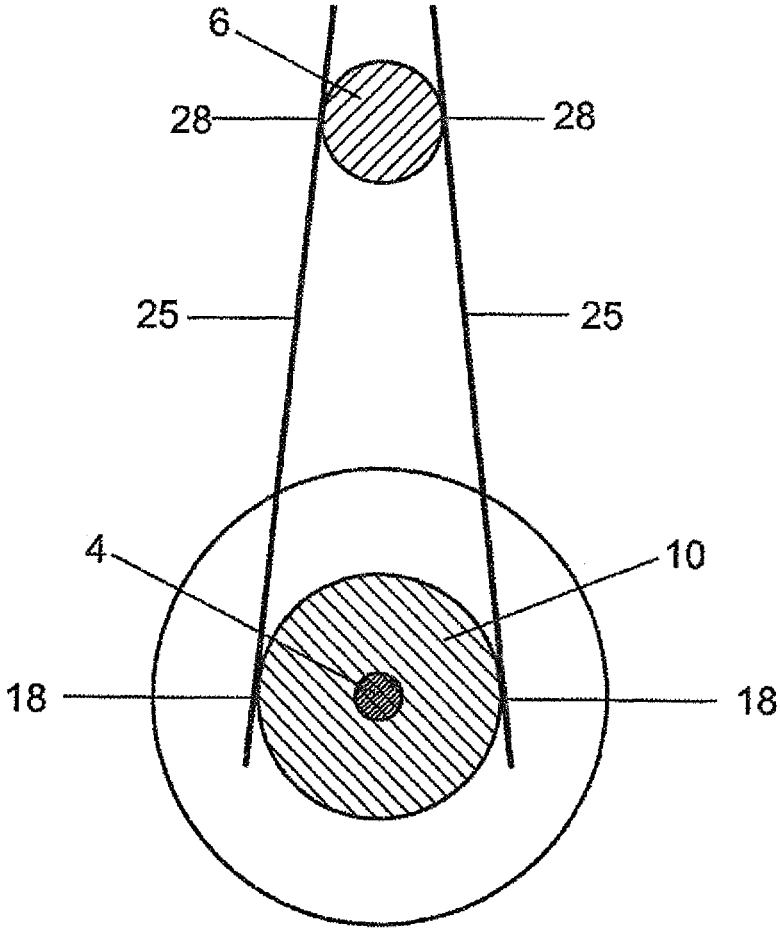
FIGS. 6 to 15 show further exemplary embodiments of a high-pressure discharge lamp.

FIG. 6 shows an exemplary embodiment wherein two plate-like foils 25 are used. Both foils are flat and lie against opposite sides 18, 28 both on the clip wire 6 and also on the capillary 10.

Figure 7:
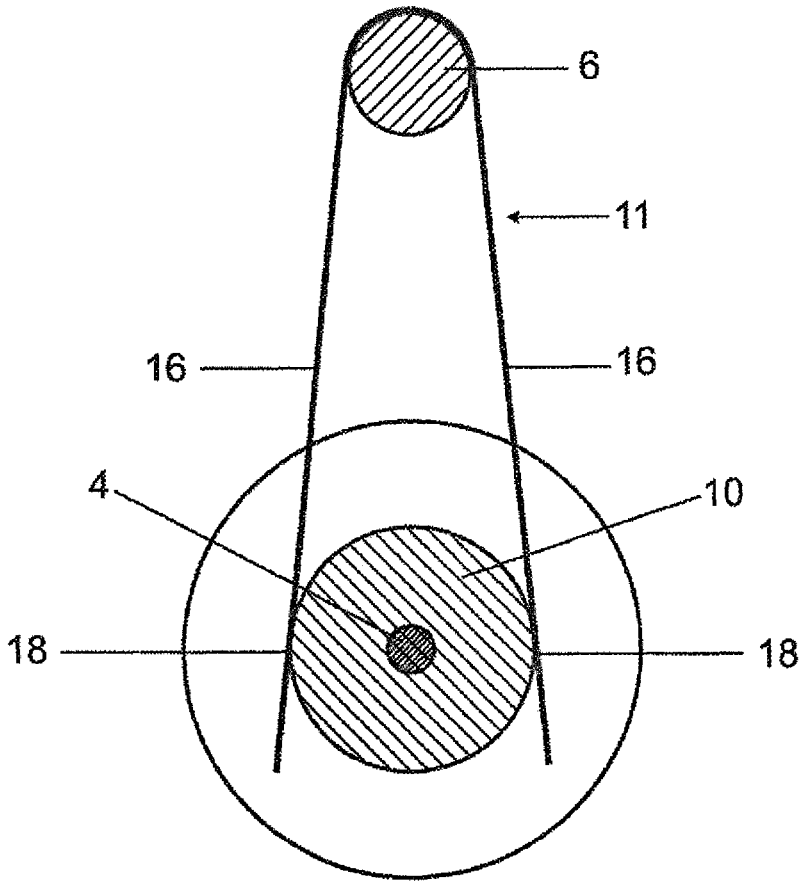

FIG. 7 shows an exemplary embodiment wherein a long foil 11 is wound around the clip wire 6 such that each of its two free ends lies purely mechanically against the capillary 10 on opposite sides 18.

Figure 8:
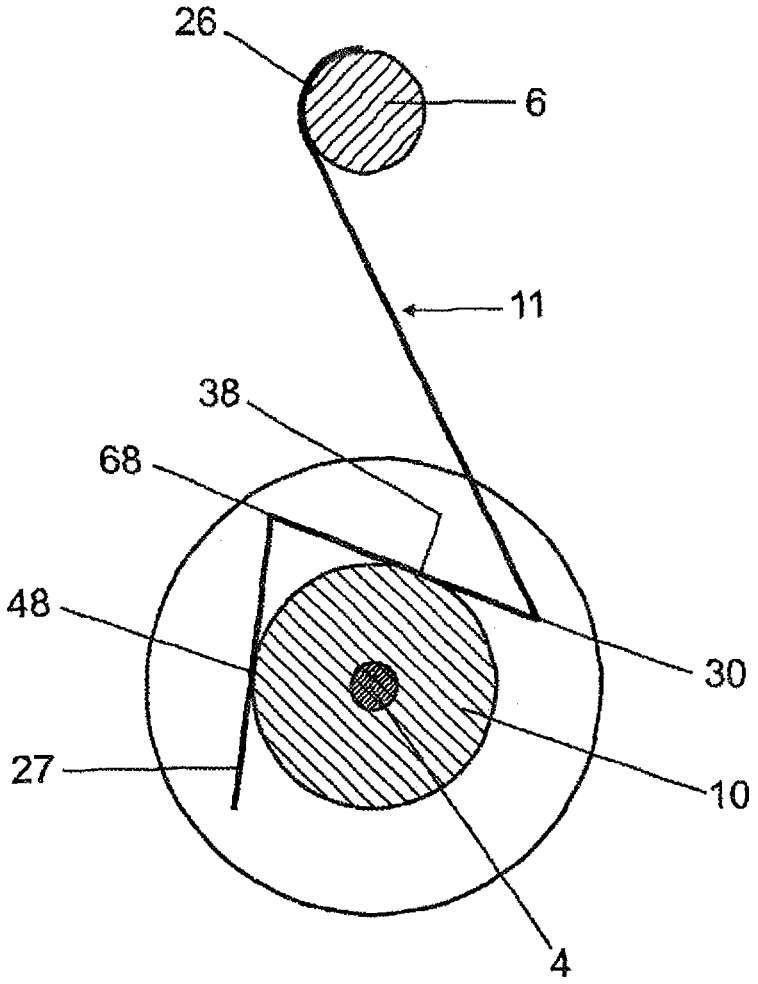

FIG. 8 shows an exemplary embodiment where a foil 11 has a plurality of angles. The first end 26 of the foil is welded to the clip wire 6, the second end 27 of the foil ends approximately on the level of the capillary 10. The foil 11 has a first kink 30 on the level of the capillary, but on the opposite side to the free end 27. From the first kink 30, the foil is routed to a first point of contact 38 with the capillary 10, up to a second kink point 68. From there, the foil is routed to a second point of contact 48 on the capillary 10 and ends shortly thereafter with the free end 27. In this exemplary embodiment, two points of contact 38, 48 are present which are offset by approximately 90° with respect to one another on the circular circumference of the capillary. The effective volume of the ignition aid is particularly high in this case.

Figure 9:
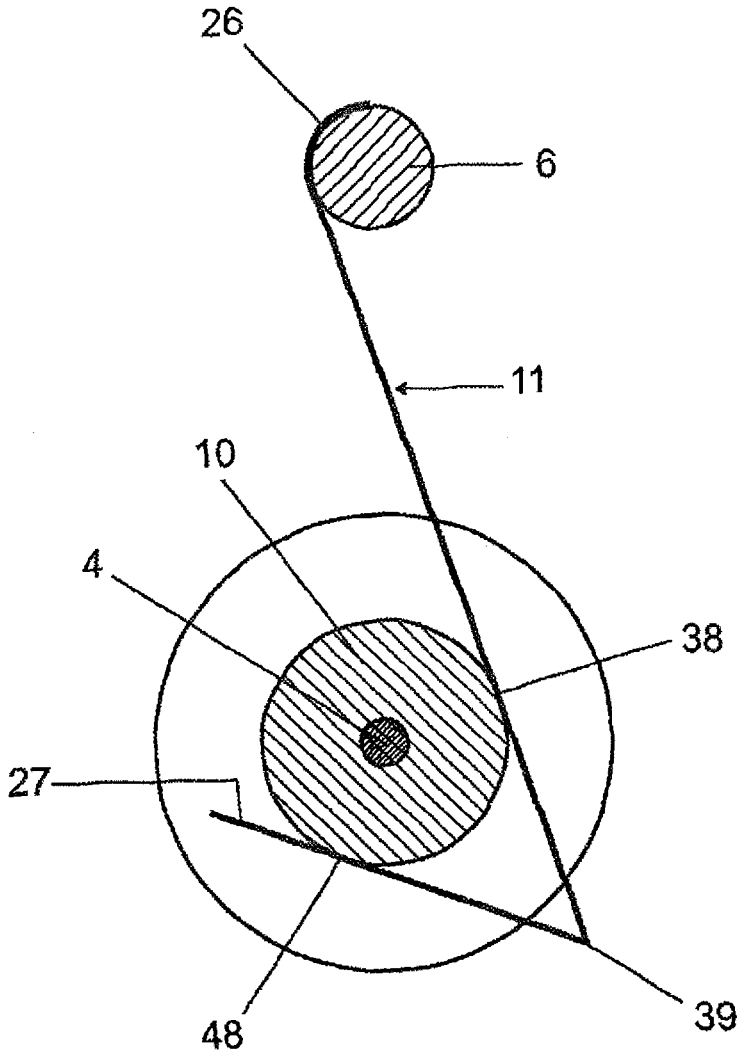

A variant of this design is shown in FIG. 9. Two points of contact are also present here. However, the foil 11 has only one kink point 39. The first end 26 of the foil is secured on a first side of the clip wire 6. From here, the foil is routed diagonally to the opposite side of the capillary 10 where it has a first tangential point of contact 38. Only then is the foil 11 kinked at an acute angle at the point 39 and routed back to the capillary 10 to the second point of contact 48. The second point of contact is also touched tangentially. The free end 27 of the foil 11 ends shortly thereafter. In this case, a single kink point 39 is therefore located between two points of contact 38 and 48. Their spacing on the circumference of the capillary is approximately 110° to 130°.

In general, the minimum spacing between foil 11 and capillary 10 should preferably be a maximum of 1 mm. In particular, the foil lies against the capillary.

Figure 10:
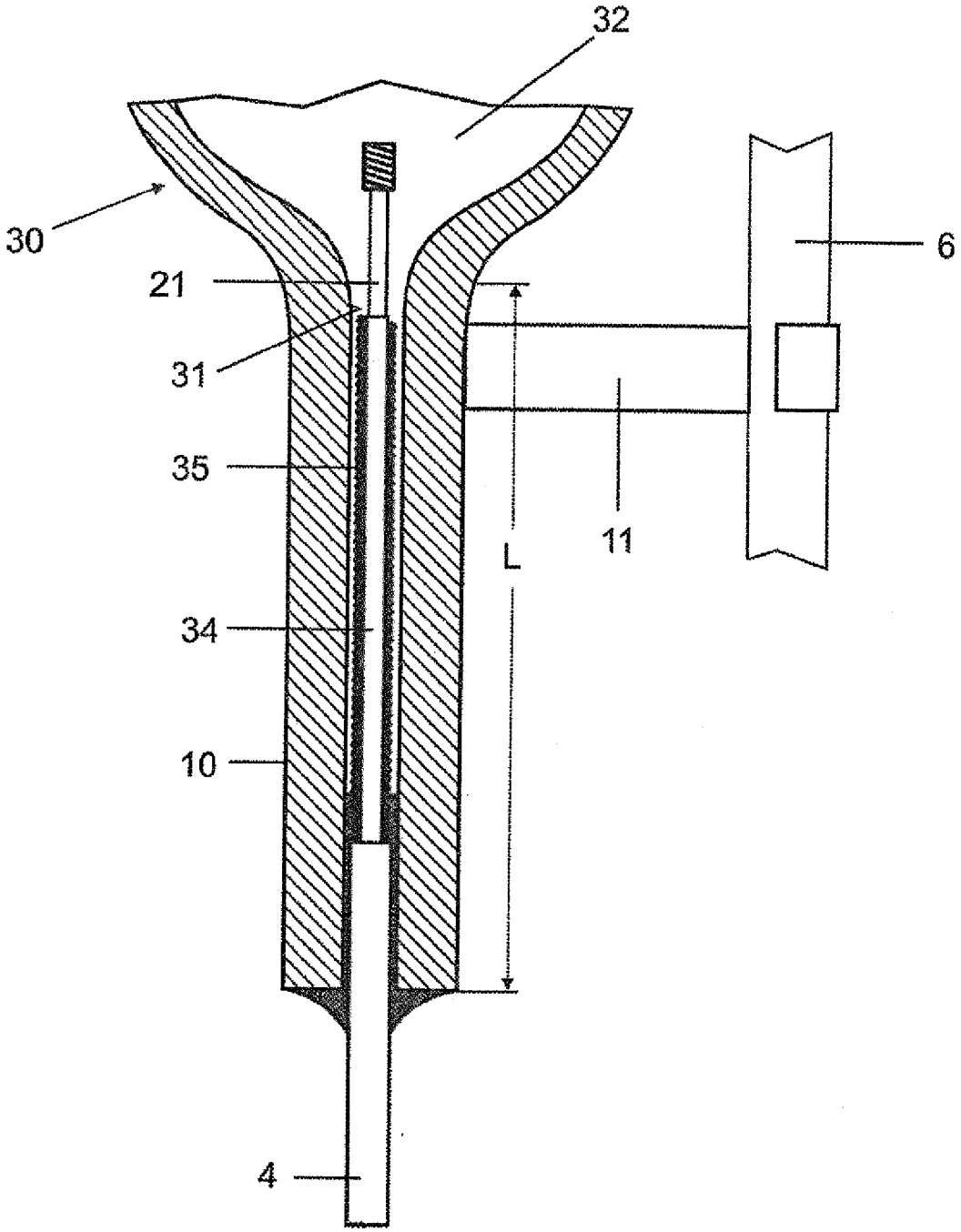

FIG. 10 shows a detail of a ceramic discharge vessel 30. It is advantageous if the ignition aid, represented by the foil 11, has its smallest distance from the capillary 10 as far as possible in that region in which the shaft 21 of the electrode, or also the feedthrough, is situated in the capillary 10.

In this situation, a relatively large distance from the wall 31 of the capillary can advantageously be present, with the result that a relatively large ionizable volume is present here. In general, this ignition aid should be situated in the first 20% of the length L of the capillary in order that part of the inhomogeneous field strength extends as far as possible into the discharge volume 32. The rear portion of the shaft or also the feedthrough 34 frequently has a spiral wound round it in order to make the dead volume there as small as possible.

Figure 11:
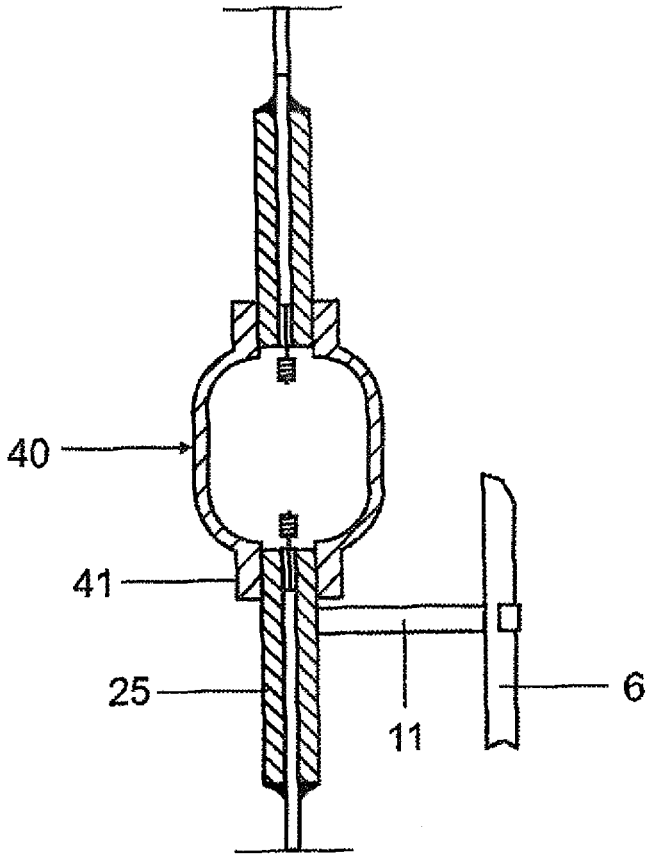

FIG. 11 shows a further exemplary embodiment of a discharge vessel 40 with end 41, wherein the capillary is represented by a separate stopper 25. It is also advantageous here if the foil 11 is situated as close as possible to the capillary just below the end 41 of the discharge vessel.

Figure 12:
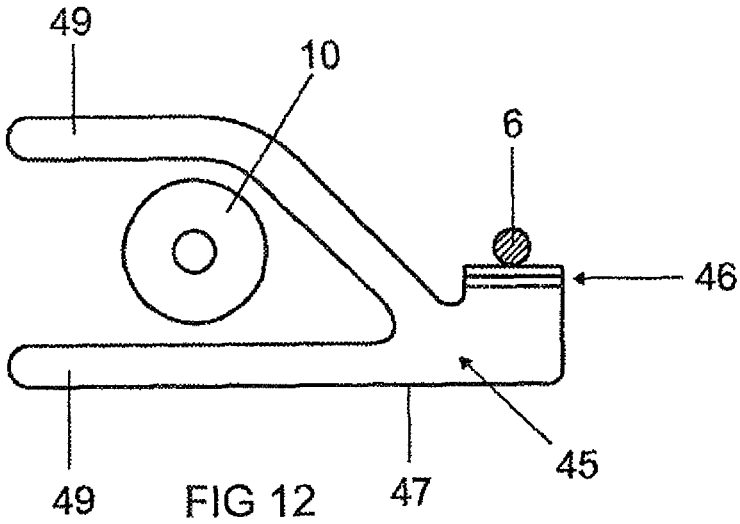

FIG. 12 shows an exemplary embodiment whereby an ignition aid is here formed as a metal plate 45. The metal plate is secured by an angled end 46 on the clip wire 6, similar to the manner described in EP 316617. The body 47 of the part situated in a plane crosswise to the axis A is preferably plate-like and slotted to form two limbs 49 in a U shape at one end, whereby this end encloses the capillary in a forceps like fashion in order to create two "points of contact".

Figure 13:
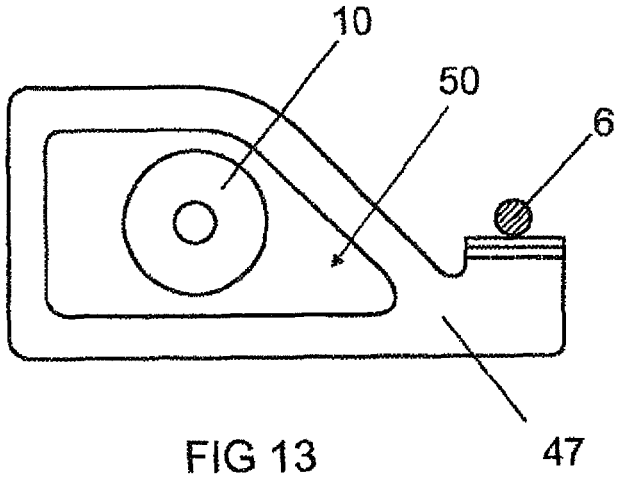

FIG. 13 shows a metal plate 45, wherein the body 47 is plate-like with a central hole 50 which loosely accepts the capillary 10.

Figure 14:
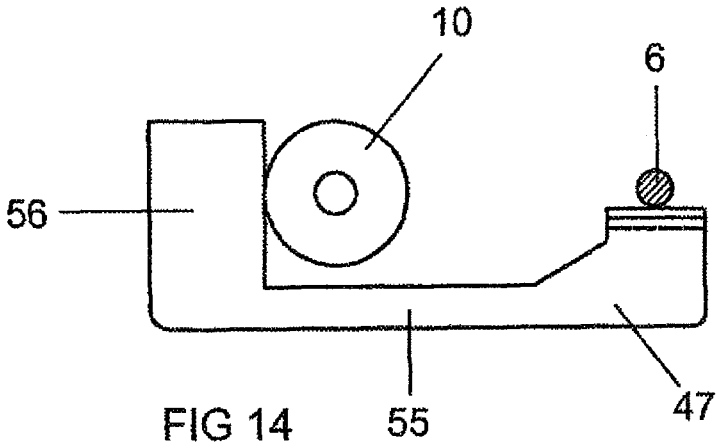

FIG. 14 shows a metal plate 45, wherein the body 47 is plate-like, with a basically L-shaped structure, wherein a long limb 55 and a short limb 56, angled away therefrom by approximately 90°, approximately half encircle the capillary 10.

Figure 15:
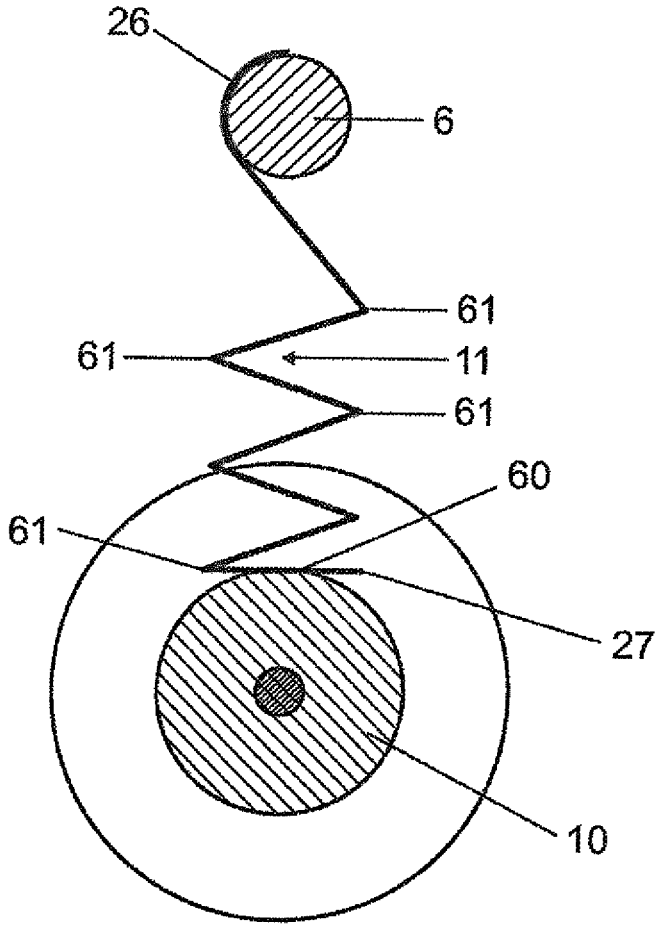

FIG. 15 shows a further exemplary embodiment with foil 11 in a variant of the design from FIG. 9. Here only one point of contact 60 is present. However, the foil 11 has a series of kink points 61 which are arranged in a concertina like fashion between first end 26 and second end 27 of the foil. The first end 26 of the foil is secured on a first side of the clip wire 6. From here, the foil is in principle rectilinear, but in detail it is routed in zigzag fashion to the capillary 10 where it has a tangential point of contact 60. This is possible because the last kink point 61 the free end 27 is suitably angled.

Figure 16:
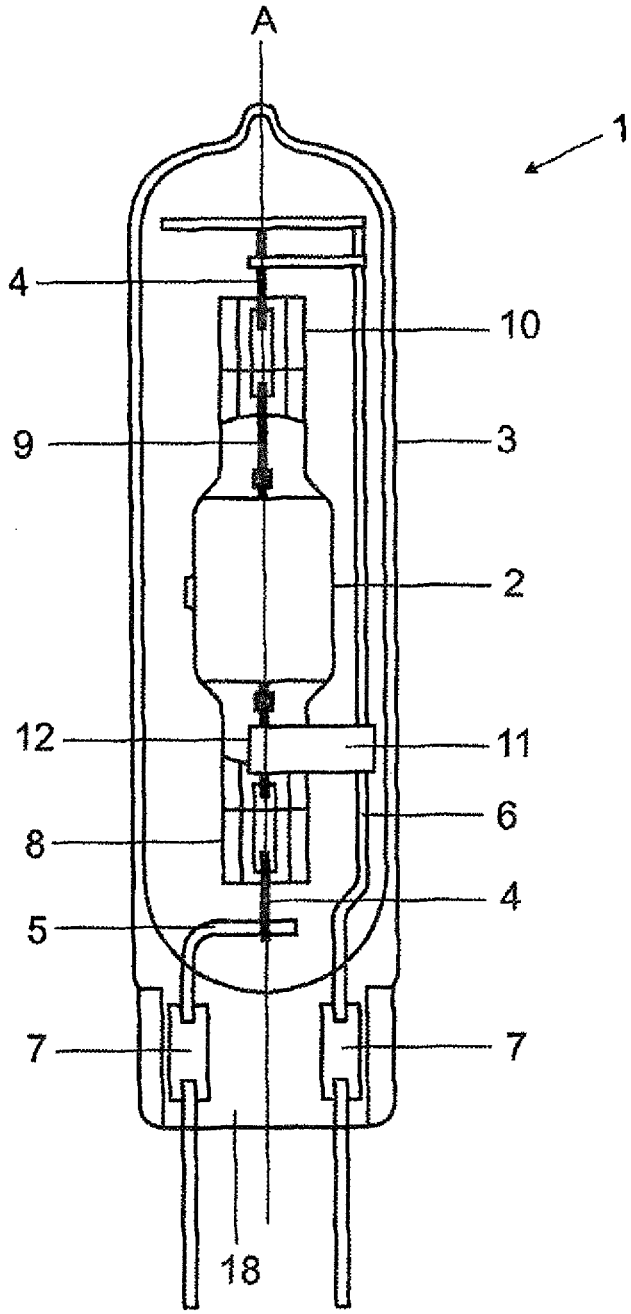
FIG. 16 shows a high-pressure discharge lamp having an ignition aid, first exemplary embodiment.

FIG. 16 shows the structure of a high-pressure discharge lamp 1 in heavily schematized form. It has a discharge vessel made of quartz glass 2 which is mounted in an outer bulb 3. The outer feed lines 4 of the discharge vessel, which contact electrodes 9 in the interior, are connected to two frame wires 5 and 6. A short frame wire 5 leads to a first foil 7 in a pinch 18 of the outer bulb. A long frame wire 6, often referred to as clip wire, leads to a second foil 7 in the pinch 18. The discharge vessel 2 has at each of its ends a pinch 10, as already known, and also a filling which contains metal halides, as likewise already known. In this situation, this may contain Hg, and also an inert gas. Two electrodes 9 are situated opposite one another in the interior of the discharge vessel, as likewise already known. A typical filling is an ionizable gas, as a rule argon or xenon, mercury and metal halides.

The clip wire 6 is essentially routed along the discharge vessel parallel to the axis A thereof to the second pinch 10 distant from the first pinch 8. There it is connected to the feed line 4.

In the region of the first pinch 8 a foil 11 which is approximately rectangular in shape is welded on the clip wire 6 in the direction of the pinch. The free end 12 of the foil extends approximately to the top of the pinch 8. It can just touch the pinch or also be routed tangentially past the pinch.

Figure 17:
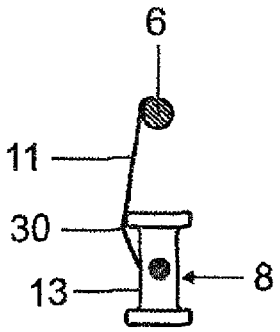
FIG. 17 shows a detail from FIG. 16.

FIG. 17 shows a detail similar to FIG. 16, wherein it can be seen that the foil 11 is bent such that it reaches from the clip wire 6 to the center of the broad side 13 of the pinch 8. In this situation, it is angled in roof-like fashion. The pinch is designed in a so-called double-T form, as already known. The roof-like angulation can be an edge 30, as shown, or also a gentle bend without a kink as in FIG. 1.

Figure 18:
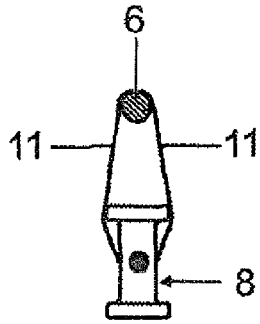
FIG. 18 shows a detail of a further exemplary embodiment.

FIG. 18 shows an exemplary embodiment, wherein two foils 11 are arranged symmetrically with respect to one another in the basic configuration from FIG. 17.

Figure 19:
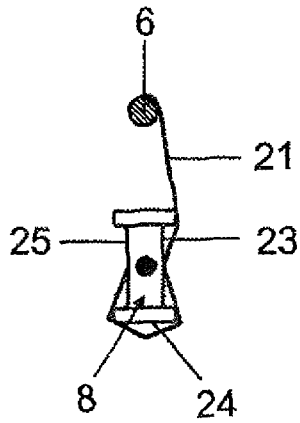
FIG. 19 shows a detail of a further exemplary embodiment.

FIG. 19 shows an exemplary embodiment, wherein a long foil 21 extends from the clip wire 6 to the first broad side 23 of the pinch. In this situation, it is angled towards the broad side 23. From there it is further extended and bent around the distant narrow side 24 of the pinch, namely to the point where it reaches the second broad side 25 of the pinch 8.

Figure 20:
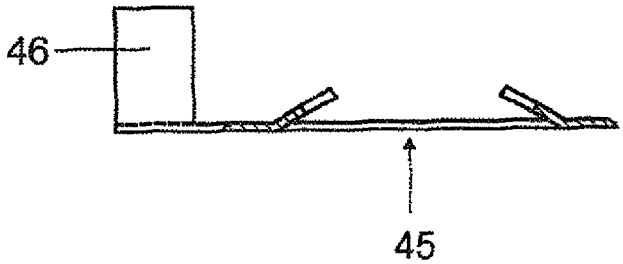
FIG. 20 shows a detail of a further exemplary embodiment.
Figure 21:
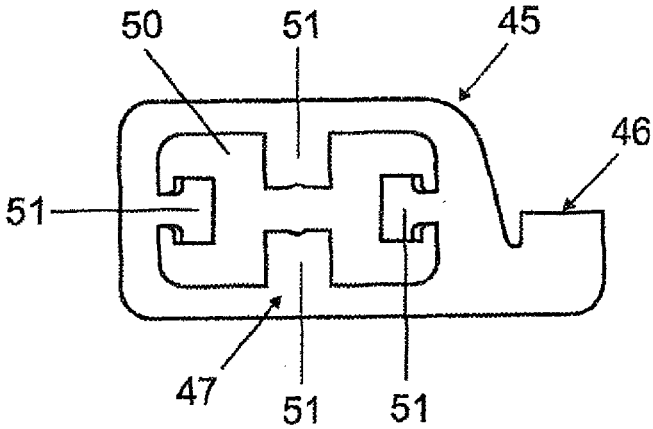
FIG. 21 shows the exemplary embodiment from FIG. 20 rotated through 90°.

FIG. 20 shows an exemplary embodiment whereby an ignition aid is here formed from sheet plate as a sprung sheet metal part 45. The sprung sheet metal part is secured by means of an angled end 46 on the clip wire 6, see FIG. 7 in this respect, similar to the manner described in EP 316617. The body 47 of the part 45 situated in a plane crosswise to the axis A is preferably plate-like with a central hole 50 which loosely accepts the pinch. In the rotated (through 90°) view shown in FIG. 21 it can be seen that the hole 50 is matched to the pinch by being patterned on the double-T form of the pinch. It also has lugs 51 for fixing to the pinch. These lugs are splayed out from the plane of the sheet metal.

Figure 22:
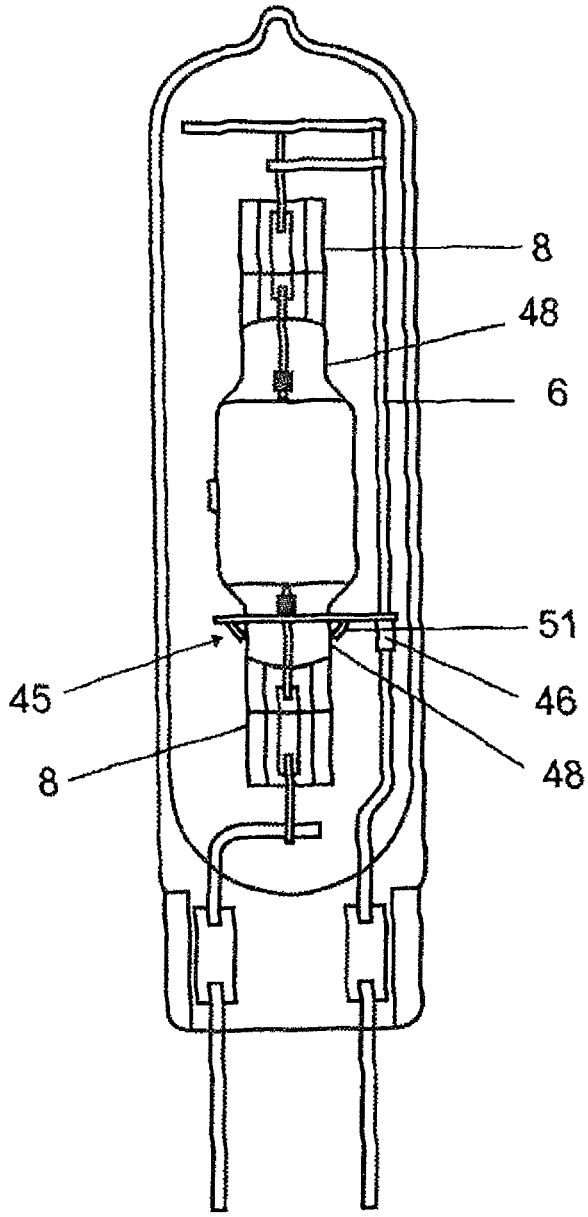
FIG. 22 shows a further exemplary embodiment of a high-pressure discharge lamp, containing the detail from FIG. 20.

FIG. 22 shows the sprung sheet metal part 45 mounted at the end 48 of the discharge vessel.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A high-pressure discharge lamp having an ignition aid and a longitudinal axis A, having a discharge vessel which is mounted in an outer bulb, wherein the discharge vessel comprises two ends having seals in which electrodes are secured, wherein a frame having a clip wire retains the discharge vessel in the outer bulb, wherein the clip wire comprises a plate-like ignition aid, facing the seal of the oppositely poled electrode, wherein the ignition aid is a foil which is flat which is angled in a zig-zag fashion.

2. The high-pressure discharge lamp as claimed in claim 1, wherein an end of the foil is free and ends near the seal.

3. The high-pressure discharge lamp as claimed in claim 2, wherein the end is partially bent around the seal.

4. The high-pressure discharge lamp as claimed in claim 2, wherein the end of the foil comprises two kink points in the vicinity of a capillary, wherein the folding of the kinks is chosen such that two points of contact with the capillary are offset by approximately 70° to 110° with respect to one another on the circumference of the capillary, wherein the second kink point is situated between the two points of contact.

5. The high-pressure discharge lamp as claimed in claim 2, wherein the end of the foil comprises one kink point in the vicinity of a capillary, wherein the folding of the kinks is chosen such that two points of contact with the capillary are offset by approximately 70° to 110° with respect to one another on the circumference of the capillary, wherein the kink point is situated between the two points of contact.

6. The high-pressure discharge lamp as claimed in claim 1, wherein the discharge vessel comprises a metal halide filling.

7. The high-pressure discharge lamp as claimed in claim 6, wherein the metal halide filling is essentially free of Na.

8. The high-pressure discharge lamp as claimed in claim 1, wherein a central section of the foil is connected to the clip wire at least mechanically or also by a friction-locked connection, while two limbs which come out in opposite directions from the central section extend at least as far as opposite sides of a capillary where they exhibit free ends.

9. The high-pressure discharge lamp as claimed in claim 1, wherein the seals are capillaries, which are integral with the discharge vessel.

10. The high-pressure discharge lamp as claimed in claim 1, wherein the two ends having seals of the discharge vessel are pinches or capillaries.

11. The high-pressure discharge lamp as claimed in claim 10, wherein a first end of the foil is connected to the clip wire and a second end is free and ends on a broad side of the pinch or on the capillary.

12. A high-pressure discharge lamp having an ignition aid and a longitudinal axis A, having a discharge vessel which is mounted in an outer bulb, wherein the discharge vessel comprises two ends having seals in which electrodes are secured, wherein a frame having a clip wire retains the discharge vessel in the outer bulb, wherein the clip wire comprises a plate-like ignition aid, facing the seal of the oppositely poled electrode, wherein the ignition aid is a metal plate which is stamped in plate-like fashion, wherein the plane of this plate-like stamped part is disposed crosswise to the longitudinal axis A, wherein the plate is essentially U-shaped, wherein the free limbs of the U enclose the capillary.

13. A high-pressure discharge lamp having an ignition aid and a longitudinal axis A, having a discharge vessel which is mounted in an outer bulb, wherein the discharge vessel comprises two ends having seals in which electrodes are secured, wherein a frame having a clip wire retains the discharge vessel in the outer bulb, wherein the clip wire comprises a plate-like ignition aid, facing the seal of the oppositely poled electrode, wherein the ignition aid is a metal plate which is stamped in plate-like fashion, wherein the plane of this plate-like stamped part is disposed crosswise to the longitudinal axis A, wherein the plate is essentially L-shaped, wherein the limbs of the L partially enclose a capillary.

* * * * *